US005795530A

United States Patent [19]

Monda et al.

[11] Patent Number: 5,795,530

[45] Date of Patent: Aug. 18, 1998

[54] METHOD AND BASE FOR TRAFFIC CHANNELIZER

[75] Inventors: Albert F. Monda; Milton Darrell Hinnant, both of Kannapolis, N.C.

[73] Assignee: Radiator Specialty Company, Charlotte, N.C.

[21] Appl. No.: 777,977

[22] Filed: Dec. 24, 1996

Related U.S. Application Data

[62] Division of Ser. No. 538,867, Oct. 4, 1995, Pat. No. 5,713,694.

[51] Int. Cl.[6] ..... B29C 41/18; B29C 33/40

[52] U.S. Cl. ..... 264/306; 264/331.11; 264/DIG. 60

[58] Field of Search ..... 264/306, 302, 264/DIG. 60, 331.11; 404/6, 9, 10, 12, 13, 32, 33; 40/606, 612; 116/636, 638; 220/603; 248/910; 256/13.1; 427/424.6, 461

[56] References Cited

U.S. PATENT DOCUMENTS

| | | | |
|---|---|---|---|
| Re. 34,614 | 5/1994 | Gentiluomo | 473/126 |
| 2,762,327 | 9/1956 | Weig | 116/63 |
| 2,964,798 | 12/1960 | Ferrell | 18/58 |
| 3,099,244 | 7/1963 | Knapp | 116/63 |
| 3,151,196 | 9/1964 | Tipton | 264/302 |
| 3,471,114 | 10/1969 | Ball | 248/346 |
| 3,913,518 | 10/1975 | Kaplan | 116/63 PC |
| 3,952,690 | 4/1976 | Rizzo et al. | 116/63 P |
| 4,177,749 | 12/1979 | Lindner | 116/63 T |
| 4,312,600 | 1/1982 | Schaaf et al. | 404/6 |
| 4,674,431 | 6/1987 | Cory | 116/63 P |
| 4,925,334 | 5/1990 | Beard | 404/9 |
| 4,973,190 | 11/1990 | Erwin et al. | 404/10 |
| 5,064,707 | 11/1991 | Weaver et al. | 428/151 |
| 5,199,813 | 4/1993 | Nagler | 404/9 |
| 5,199,814 | 4/1993 | Clark et al. | 0404/10 |
| 5,201,599 | 4/1993 | Kulp et al. | 404/6 |
| 5,234,280 | 8/1993 | Cowan | 404/6 |
| 5,451,118 | 9/1995 | Wilkins et al. | 404/6 |

*Primary Examiner*—Jan H. Silbaugh
*Assistant Examiner*—Suzanne E. Mason
*Attorney, Agent, or Firm*—Bell Seltzer Intellectual Property Law Group of Alston & Bird LLP

[57] ABSTRACT

A resilient and flexible base for a two-piece traffic channelizer is provided that does not require external ballasting to stabilize the channelizer against wind forces and vacuum forces created by passing vehicles and minor impacts from a vehicle. The base is formed of a hardenable liquid resin such that the base is resilient and flexible after curing and has a specific gravity greater than about 1.25. The base further includes at least one flexible footpad for generating a restoring moment when the channelizer is subjected to a tipping force, such as a minor impact. The composition of the liquid resin includes at least one off-grade polyvinylchloride (PVC) resin, a plasticizer and a specific gravity increasing agent. A method is also provided for forming the base by slush molding at least a portion of the hardenable liquid resin adjacent the interior surface of a molding cavity. The base formed by the disclosed method is also self-lubricating and resistant to chemical degradation and extreme temperatures.

10 Claims, 4 Drawing Sheets

METHOD AND BASE FOR TRAFFIC CHANNELIZER

RELATED APPLICATIONS

This application is a divisional of application Ser. No. 08/538,867 filed Oct. 4, 1995, now U.S. Pat. No. 5,713,694.

FIELD OF THE INVENTION

The invention relates to a base for a traffic channelizer and a method of forming a base for a traffic channelizer.

BACKGROUND OF THE INVENTION

Traffic channelizers are used on roadways to warn motorists of road hazards and to direct traffic along a desired route. For example, a series of traffic channelizers may be positioned one after another along the roadway to channel traffic in a construction zone from one or more lanes into fewer lanes.

Typically, traffic channelizers are barrel-shaped and are made of metal or plastic. Metal channelizers have the advantage that they are heavy. The weight of the metal channelizer helps to prevent it from being displaced by wind forces and vacuum forces created by passing vehicles. Metal channelizers, however, present a significant safety hazard. If struck by a passing vehicle, the channelizer may damage the vehicle or may be displaced onto the roadway and become a hazard to other motorists. Metal channelizers also present storage and handling problems. Because they typically are not stackable, metal channelizers require additional space to store and to transport to a worksite. Once transported to the worksite, metal channelizers are difficult to place and to relocate on the roadway.

Accordingly, most modern traffic channelizers are of a two-piece construction consisting of a base and a hollow drum and are made of a lightweight, plastic material, such as polyethylene. The base is placed on the surface of the roadway. The barrel-shaped drum is positioned onto the base over a connecting flange that extends upwardly from the base. The reduction in weight realized with a plastic channelizer provides significant advantages from the standpoint of handling, storage and transportation. In addition, a plastic drum causes less damage to motor vehicles when impacted and is less of a hazard to motorists when displaced or tipped.

The reduced weight of the plastic base, however, requires the channelizer to be stabilized against displacement from wind forces and vacuum forces created by passing vehicles. The drum must also be stabilized against tipping in the event of a minor impact from a vehicle so that the channelizer will remain in an upright orientation visible to motorists. In addition, the plastic base may be permanently deformed when impacted by a vehicle, and thus may need to be replaced, and is somewhat subject to chemical degradation and extreme temperatures.

Conventional plastic channelizers are typically stabilized against displacement and tipping by the addition of ballast to the base. The ballast, typically in the form of a sandbag, is placed on top of the base to hold the base and the attached drum in the desired location when the channelizer is exposed to wind forces and vacuum forces created by passing vehicles. In addition, concentrating the distribution of weight in the lowermost portion of the channelizer serves to stabilize the channelizer against tipping while enabling the drum to "break-away" from the connecting flange of the base when impacted by a vehicle. Thus, the base is more likely to remain in the desired location and the drum is less likely to be displaced onto the roadway.

The sandbag, however, may break open if the drum of the channelizer is struck and the base is run over by a vehicle. As a result, the sand inside may be spread onto the roadway and create a safety hazard. The sandbag, because of its height above the surface of the roadway, may also damage a vehicle passing over the sandbag. In any event, further use of the channelizer requires that the sandbag be replaced on the channelizer base, and oftentimes, that the sandbag be refilled. In the meantime, the unballasted base should be removed from the roadway so that it does not become a safety hazard, and/or is not destroyed by repeated impacts from passing vehicles.

A proposed solution to the problems associated with an externally ballasted, plastic base is to provide a hollow base that may be filled with ballast. U.S. Pat. No. 5,026,204 issued Jun. 25, 1991 to Kulp, et al. discloses a two-piece traffic channelizer including a hollow, plastic base. The base is filled with a ballast material, such as damp sand, and sealed so that the sand is usually retained if the channelizer is struck by a vehicle.

The Kulp base, however, is typically and preferably filled using sand-filling equipment and then transported to the roadway. Significantly, the vertical height of the base must be sufficient for the base to contain the volume of sand necessary to stabilize the channelizer against displacement and tipping. The resulting geometry and rigidity of the base, however, increases the likelihood that the base may tip up when the channelizer is impacted by a vehicle and thus damage or destabilize the vehicle. Further, the Kulp base, because it is made of a rigid plastic, is subject to chemical degradation as well as the adverse effects of extreme temperatures.

U.S. Pat. No. 5,234,280 issued Aug. 10, 1993 to Cowan discloses another proposed solution to the problems associated with an externally ballasted, plastic channelizer. The patent to Cowan discloses positioning a rubber collar, in the form, for example, of the bead and integral side wall portion of a recycled truck tire, around the exterior circumference of the base to act as ballast. The rubber collar eliminates the need for sand ballast. Further, the rubber collar contacts the roadway over a large surface area and provides the channelizer with a relatively low center of gravity to stabilize the channelizer against displacement and tipping. The rubber collar, however, is not integral with the base and typically is stored and transported to the worksite separately. Further, the rubber collar substantially increases the overall area of the footprint of the channelizer on the roadway.

Thus, prior art channelizer bases provide the necessary weight to stabilize a lightweight channelizer typically at a cost of increased bulk and rigidity or the necessity of furnishing a separate ballast. The resulting storage, labor, and assembly considerations increase overall cost, decrease convenience and complicate maintenance and distribution of the traffic channelizers.

SUMMARY OF THE INVENTION

It is therefore an object of the invention to provide a base for a two-piece traffic channelizer which addresses deficiencies of prior art channelizers.

It is another, and more particular, object of the invention to provide a base for a traffic channelizer that does not require external ballasting, such as with a sandbag or a rubber collar.

It is another object of the invention to provide a base for a traffic channelizer that does not require filling with a ballast material, such as sand.

It is another object of the invention to provide a base for a traffic channelizer that stabilizes the channelizer against displacement and tipping.

It is another object of the invention to provide a resilient base for a traffic channelizer that is impact resistant, resistant to chemical degradation and extreme temperatures.

It is another object of the invention to provide a method for forming a base for a two-piece traffic channelizer from a hardenable liquid resin which is resilient after curing.

It is another object of the invention to provide a method for forming a base for a traffic channelizer in which the base may be readily manufactured while minimizing capital investment and any necessity for substantial changes in the associated channelizer drum.

These and other objects are accomplished by the channelizer base and the method of forming the channelizer base of the invention. The traffic channelizer of the invention includes the base and a barrel-shaped drum defining a longitudinal axis. The drum is preferably made of a lightweight plastic, such as polyethylene, so that the drum will break-away and separate from the base when impacted by a vehicle. The lower end of the drum is open and shaped on its interior surface to receive a connecting flange provided on the base.

The base is generally solid, substantially flat, and is formed of a hardened, resilient, plastic material having a specific gravity greater than about 1.25. The high specific gravity material and the geometry of the base allow for the provision of a minimum weight of about 8 pounds, and preferably, a weight between about 15 and about 40 pounds, without the necessity of added ballast. The high specific gravity base of the invention is advantageously constructed to provide a substantially uniform and radially symmetric distribution of the weight of the base thus increasing the stability of the base against tipping and displacement as compared to the non-uniform, non-symmetrical weight distribution of a base externally ballasted with a sandbag or internally ballasted with sand. The resiliency of the material results in a flexible base that is energy absorbing and conforms to the surface of the roadway. Accordingly, the base of the invention is significantly less likely to tip or fly up when the channelizer is struck by a vehicle, or to damage a vehicle passing over the base or destabilize the vehicle and cause the driver of the vehicle to lose control.

The base of the invention is preferably formed of a hardenable liquid resin composition that is substantially resilient after curing and is relatively heavy compared to the weight of the lightweight, plastic drum. The preferred hardenable liquid resin comprises polyvinylchloride (PVC), a plasticizer and a specific gravity increasing agent. Preferably, the composition of the hardenable liquid resin has a composite specific gravity greater than about 1.25 so that the weight of a cured base having a diameter less than about three feet is greater than about 8 pounds. The liquid resin composition advantageously includes a high specific gravity filler, a coloring agent, a stabilizing agent, a viscosity adjusting agent and a lubricating agent.

Preferably, the liquid resin composition includes at least one recycled component such as off-grade, recycled PVC resin, a substantial quantity of a plastizer such as dioctyl terephthalate (DOTP), a high specific gravity filler such as barytes foam-A, a coloring and opacifying agent such as austin black and/or a filler, calcium oxide and mineral spirits in amounts sufficient to form a resilient base which is resistant to chemical degradation and extreme temperatures. Preferably, the base is manufactured economically and without substantial capital investment using a slush molding process described in greater detail hereinafter. The DOTP or other plasticizer in combination with the base resin, preferably PVC, provides the resiliency which allows the base to withstand repeated impacts from vehicles without permanently deforming or breaking apart. The flexibility of the base permits the base to conform to the surface of the roadway and to absorb and dissipate impact or other force by bending which also allows an improved contact with the road surface when force such as a vehicle impact is applied to the barrel.

The high specific gravity filler, preferably barytes foam-A, permits the base to have a weight sufficient to stabilize the channelizer against displacement and tipping without external ballasting. The coloring and opacifying agent such as austin black serves as an additional filler and produces a dark color and consistent appearance even when recycled materials are included in the composition. The calcium oxide acts as a desiccant, or drying agent, to chemically remove any excess moisture from the composition. The mineral spirits modify the viscosity to enhance processing characteristics of the composition. Following hardening of the resin the plasticizer in the resin composition provides flexibility and migrates to the outer surfaces of the base over an extended period of time such that the base retains a shiny surface appearance and a lubricated surface which assists attachment and removal of the barrel.

The base includes a top surface and a bottom surface for contacting the surface of the roadway. The base also includes an inner portion positioned within the drum body, an outer portion positioned exterior of the drum body, and a medial portion positioned between the inner portion and the outer portion. The outer portion is preferably thinner than the medial portion and the inner portion, but may be thicker than the medial portion and the inner portion depending on the weight of the base required for a specific application.

A connecting flange extends upwardly from the top surface of the medial portion of the base adjacent the outer portion. The connecting flange has an undercut extending circumferentially around the flange for engaging a lip provided on the inside surface of the lower end of the drum. The connecting flange provides a secure snap-fit between the base and the drum such that the drum will not be separated from the base by wind forces or vacuum forces created by passing vehicles, or by minor impacts from vehicles. The connecting flange, however, permits the drum to break-away from the base when impacted by a vehicle traveling in excess of about twenty miles per hour.

The base further includes at least one flexible footpad on the outer portion extending radially outwardly of the drum. Preferably, the base includes a plurality of flexible footpads circumferentially-spaced around the periphery of the base. The footpads are advantageously arranged in sufficiently close relation around the periphery of the base such that at least a portion of at least one of the footpads is always in contact with the roadway when the channelizer is tipped. More preferably, four footpads are arranged around the periphery of the base at about 90 degree increments.

The footpads also provide a foot rest on their top surfaces to allow anchoring of the base via foot pressure to assist in separating the drum from the base. Preferably, at least one of the footpads also has an opening therethrough defining a handle for assisting a user to place or reposition the base on the roadway. The footpads preferably define a spring hinge portion positioned between the periphery of the footpad and the main body of the base which serves to produce a restoring moment when the channelizer is tipped. As described hereafter, the restoring moment assists the channelizer to return to an upright orientation when subjected to a tipping force, such as a minor impact from a vehicle.

The medial and the outer portions of the base advantageously make up between about 65% and about 90% of the total weight of the base. Preferably, about 80% of the total weight of the base is distributed in the medial and outer portions of the base. When subjected to a tipping force, the channelizer pivots from its initial vertical position about a tipping axis located on the opposite side of the channelizer from the tipping force and directed perpendicular to a radial extending from the longitudinal axis defined by the drum. The resilient footpads bend about the tipping axis, thereby storing energy in the hinge spring at the attachment of the footpads to the base. It is believed that the combination of the restoring moment in the spring hinge defined by the footpads and the distribution of weight around the periphery of the base opposite the tipping axis serves to restore the channelizer to an upright orientation when tipped as much as about 60 degrees from vertical, e.g., as a result of a minor impact.

According to the method of the invention, the base is formed by a slush molding process such that a plurality of bases may be economically manufactured at a relatively high production rate compared to other molding processes typically used for resilient elastomeric parts having similar thickness. Preferably, the base is formed by introducing a hardenable liquid resin into a molding cavity in an amount sufficient to cover a predetermined portion of the interior surface of a mold which is heated prior or subsequent to introduction of the liquid resin. The liquid resin in the mold is conductively heated by contact with the heated mold until at least a portion of the resin adjacent the interior surface of the mold is gelled or hardened. Preferably the resin is conductively heated by preheating the mold and allowing the liquid resin adjacent the interior surface of the mold to harden under ambient conditions.

Preferably, a portion of the liquid resin is not hardened. The non-hardened liquid portion forms a layer separate from the hardened resin adjacent the interior surface of the mold, and can be poured out of the mold and collected for recycling to form another base. The hardened liquid resin remaining in the mold may then be further cured in a conventional oven to obtain a predetermined degree of cure and resiliency. After the hardened liquid resin in the mold is cooled, the base is separated from the mold. Typically, the molded base does not require additional manufacturing operations, such as trimming or flash removal once the finished base is separated from the mold.

As is now apparent, the invention provides a base for a traffic channelizer that does not require external ballasting to stabilize the base against displacement and tipping caused by wind forces and vacuum forces created by passing vehicles and minor impacts from a vehicle. The invention also provides a method for forming a base for a traffic channelizer which permits the base to be economically manufactured at a high rate of production.

BRIEF DESCRIPTION OF THE DRAWINGS

Having set forth some of the objects and advantages of the invention, other objects and advantages will appear as the description of the invention proceeds in conjunction with the following drawings in which.

DETAILED DESCRIPTION OF THE PREFERRED EMBODIMENTS

Figure 1:
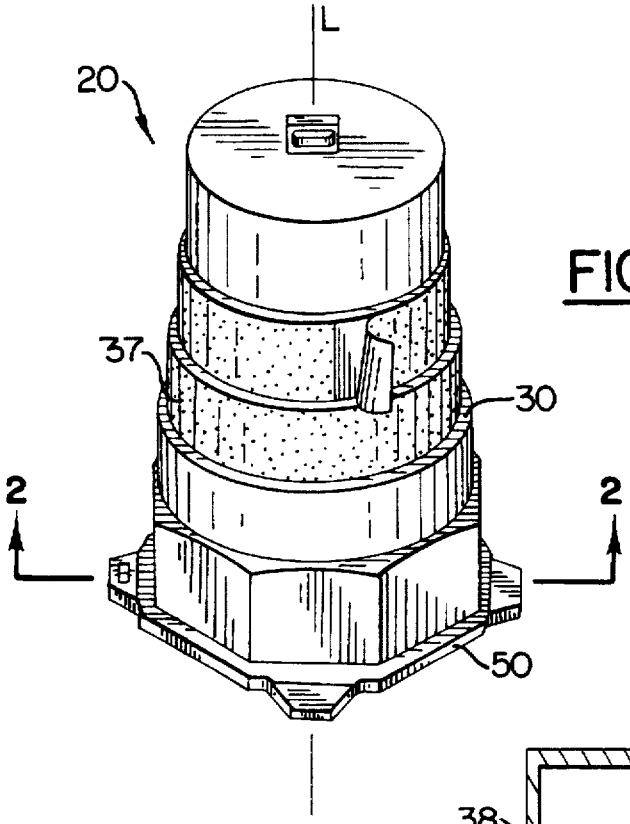
FIG. 1 is a perspective view of a two-piece traffic channelizer including a base according to the invention.

Referring to the accompanying drawings, FIG. 1 illustrates a two-piece traffic channelizer, indicated generally at 20, according to the invention. The traffic channelizer 20 comprises a hollow, barrel-shaped drum 30 defining a longitudinal axis L and a generally flat base 50 for supporting the drum in an upright, vertical orientation.

Figure 2:
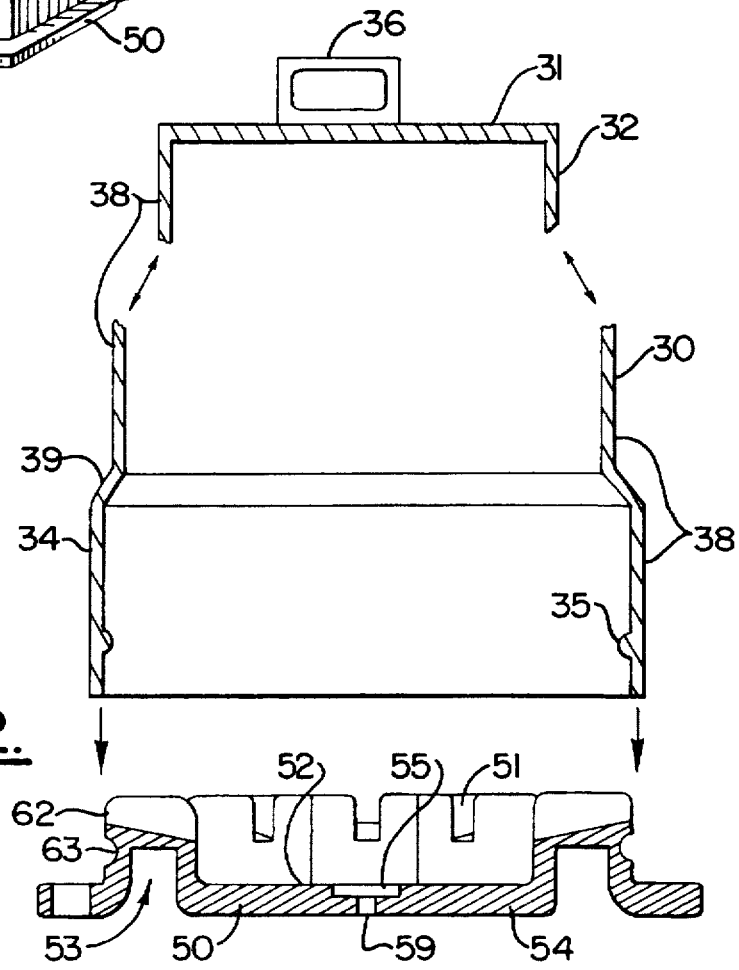
FIG. 2 is a sectional view of the traffic channelizer of FIG. 1 taken along line 2—2.

As shown in FIG. 2, drum 30 comprises an upper end 32 and a lower end 34. Upper end 32 may be open, but preferably, is closed by a top surface 31. Lower end 34 is open and comprises a lip 35 on the inside surface for engaging a connecting flange provided on the base 50. As will be described hereafter, the connecting flange provides a secure snap-fit between the base 50 and the drum 30 in the assembled configuration.

The drum 30 may have a constant diameter or, as shown, may comprise a series of cylindrical sections 38 having an increasing diameter in the direction of the lower end 34 of the drum. The telescoping sections 38 permit a plurality of drums 30 to be stacked together for storage and for transportation to a worksite. The sections 38 may have any cross section, but preferably, are circular. More preferably, the lowermost section 38 has an octangular cross section such that the drum resists rolling on the roadway after being separated from the base 50, such as when impacted by a vehicle.

The drum 30 is made of a lightweight plastic material, such as polyethylene, so that the drum will not cause damage when impacted by a vehicle or create a safety hazard for other motorists. The drum 30 may also comprise reflective tape 37 (FIG. 1) around the circumference of the drum, or a warning light 36 attached to the top surface 31 of the drum to warn motorists at night of the presence of the channelizer 20 on the roadway. Preferably, the reflective tape 37 is positioned within sections 38 between radially extending ridges 39 such that the reflective tape is not damaged when a plurality of drums 30 are stacked together for storage or for transportation. A detailed description of a lightweight, polyethylene plastic drum for a traffic channelizer is disclosed in U.S. Pat. No. 4,674,431 issued Jun. 23, 1987 to Cory, and assigned to the present assignee, the disclosure of which is herein incorporated by reference.

Figure 3:
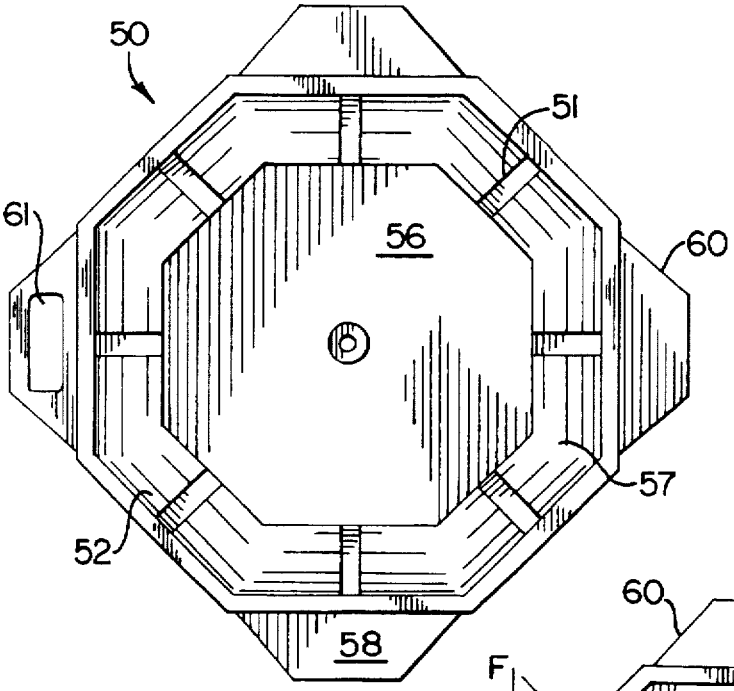
FIG. 3 is a top view of the base of the channelizer of FIG. 1.
Figure 4:
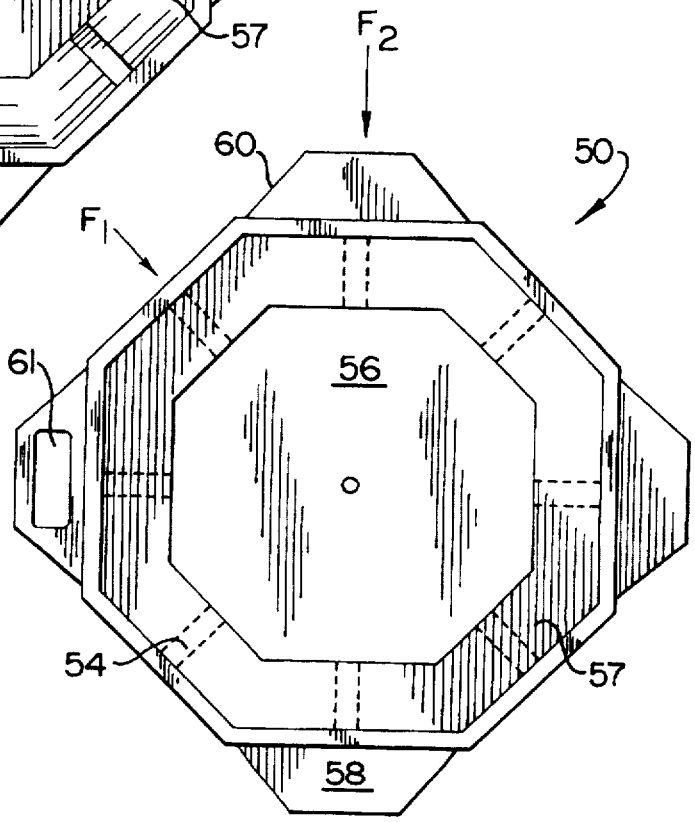
FIG. 4 is a bottom view of the base of the channelizer of FIG. 1.

The base 50 for supporting drum 30 on the roadway is generally flat and comprises a top surface 52 and a bottom surface 54 for contacting the surface of the roadway. As shown in FIGS. 3 and 4, the base 50 further comprises an inner portion 56, an outer portion 58 and a medial portion 57 positioned between the inner portion and the outer portion. A connecting flange 62 (FIG. 2) extends upwardly from the top surface 52 of the medial portion 57 of the base adjacent the outer portion 58. The connecting flange 62 has an undercut 63 extending circumferentially around the flange for engaging a lip 35 provided on the inside surface of the lower end 34 of the drum 30. The connecting flange 62 provides a secure snap-fit between the base 50 and the drum 30 such that the drum will not be separated from the base by wind forces or vacuum forces created by passing vehicles, or by minor impacts from vehicles. The connecting flange 62, however, permits the drum 30 to break-away from the base 50 when subjected to a greater force, such as an impact from a vehicle traveling in excess of about twenty miles per hour.

The outer portion 58 is preferably thinner than the medial portion 57 and the inner portion 56. The outer portion 58 may, however, be thicker than the medial portion 57 and the inner portion 56 depending on the weight of the base 50 required for a specific application. For example, if the weight of the base 50 is required to be greater than about 15 pounds, the outer portion 58 will typically be thinner than the medial portion 57 and the inner portion 56. If, on the other hand, a base 50 weighing less than about 15 pounds is required, the outer portion 58 (which preferably remains constant) will typically be thicker than the medial portion 57 and the inner portion 56.

The medial portion 57 preferably comprises a plurality of channels 51 spaced circumferentially and a downwardly-facing cavity 53 (FIG. 2) formed in the bottom surface 54 and defining an annular opening. The channels 51 may be inclined slightly from the inner portion 56 in the direction of the outer portion 58 to permit water that may accumulate on the inside of the channelizer 20 to drain onto the inner portion. The channels 51 define hinges between adjacent circumferential sections of the base 50 that increase the capability of the base to conform to the surface of the roadway and to withstand repeated impacts from vehicles without permanently deforming or breaking apart. The channels 51 additionally improve flexibility of the base thus allowing force to be absorbed by bending.

Because of the flexibility of the base, a downward force exerted on the top surface 52 of the base 50, such as when the drum 30 is separated and a vehicle passes over the base, creates a downward movement of the bottom surface of the cavity 53 between the outer portion 58 and the inner portion 56 thus increasing contact with the road. It is believed that this increased contact, the flexibility of the base 50 and the compression of the top surface 52 of the base contribute to an increase in the gripping, or anti-skid, capability of the bottom surface 54 of the base 50 relative to the surface of the roadway. When the drum 30 is attached to the base 50, the flexibility of the base 50 and the weight provided by the high specific gravity material combine to produce creep characteristics (due to the coefficient of friction of the base) comparable to elastomeric rubber. Thus, the base is less likely to be displaced when subjected to wind forces and vacuum forces created by passing vehicles and minor impacts from a vehicle than a ballasted base made of a rigid plastic material.

The inner portion 56 includes an upwardly-facing cavity 55 (FIG. 2) formed in the top surface 52 and a drain hole 59 which extends through the base 50 from the top surface 52 to the bottom surface 54. The drain hole 59 permits fluid which may accumulate on the top surface 52 of the inner portion 56 to drain through the base 50 to the roadway beneath the base.

As best shown in FIGS. 3 and 4, the base 50 further includes at least one flexible footpad 60 on the outer portion 58 extending radially outwardly from the medial portion 57. Preferably, the base 50 includes a plurality of flexible footpads 60 circumferentially-spaced around the periphery of the base. The footpads 60 are arranged in sufficiently close relation around the periphery of the base 50 such that at least a portion of at least one of the footpads 60 is always in contact with the roadway when the channelizer is tipped. In the illustrated embodiment, the footpads 60 are arranged around the periphery of the base 50 at about 90 degree increments.

The footpads 60 provide a foot rest on the top surface 52 of the base 50 to assist in separating the drum 30 from the base. Preferably, at least one of the footpads also has an opening 61 therethrough defining a handle for assisting a user to place the base 50 on the surface of the roadway and to reposition the base in a different location. The footpads 60 define a spring hinge H (FIG. 6) with the base 50 adjacent the medial portion 57 which serves to produce a restoring moment RM when the channelizer 20 is tipped. As described hereafter, the restoring moment RM assists the channelizer 20 to return to an upright orientation when subjected to a tipping force F (FIG. 5), such as a minor impact from a vehicle.

The medial 57 and outer 58 portions of the base 50 preferably make up between about 70% and about 90% of the total weight of the base. Preferably, at least about 80% of the total weight of the base is distributed in the medial 57 and outer 58 portions of the base. When subjected to tipping force F, the channelizer 20 rotates about a tipping axis T located on the opposite side of the channelizer 20 from the tipping force and directed perpendicular to a radial extending from the longitudinal axis L defined by the drum 30. The resilient footpads 60 bend about the tipping axis T thereby storing energy in the hinge spring H at the attachment of the footpads to the medial portion 57 of the base 50.

Figure 5:
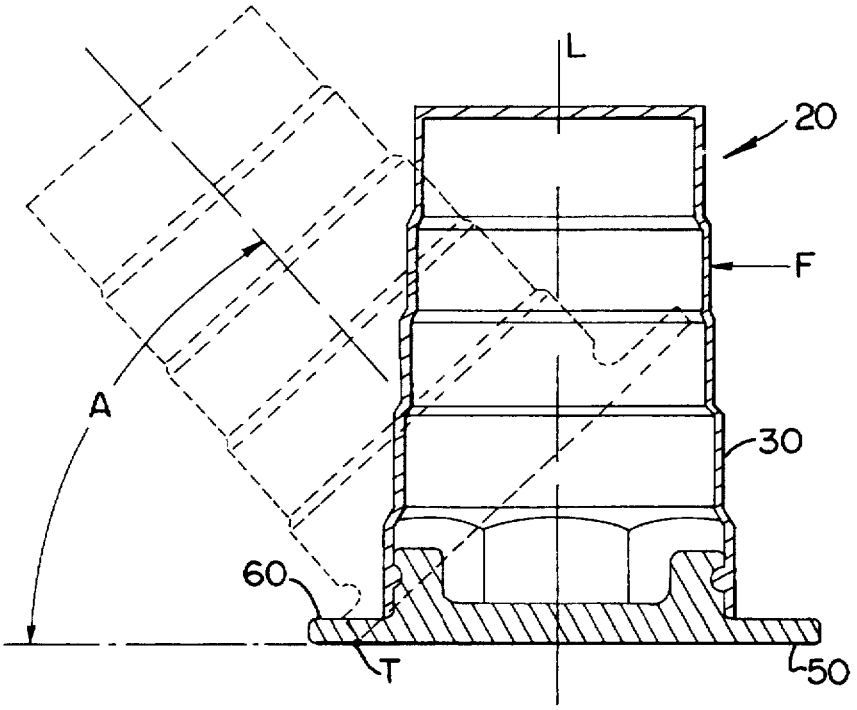
FIG. 5 illustrates the traffic channelizer of FIG. 1 subjected to a tipping force, such as a minor impact from a vehicle, about a tipping axis.
Figure 6:
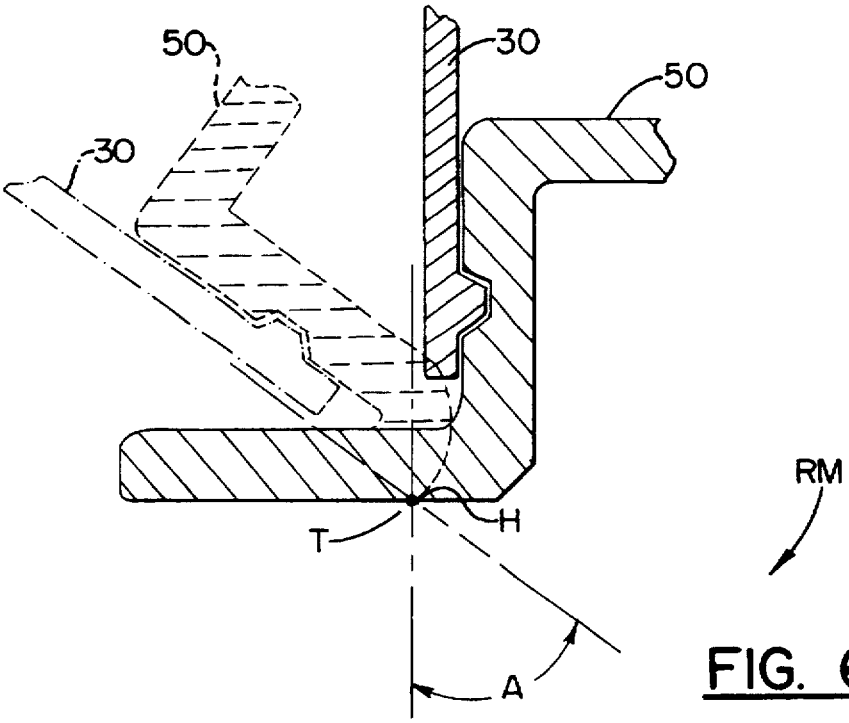
FIG. 6 is an exploded view of the tipping axis of the channelizer of FIG. 5.

For example, as illustrated in FIGS. 5 and 6, when the channelizer 20 is subjected to a tipping force F the channelizer rotates about tipping axis T on footpad 60. At least a portion of the footpad 60 adjacent the tipping axis T remains in contact with the surface of the roadway. It has been determined that a channelizer 20 subjected to a tipping force F such that a portion of two of the footpads 60 remain in contact with the roadway can be tipped up to about 50 degrees and still return to an upright orientation.

A channelizer 20 subjected to a tipping force F such that a portion of one footpad 60 remains in contact with the roadway can be tipped up to about 60 degrees and still return to an upright orientation. In contrast, a channelizer 20 without footpads 60 subjected to a tipping force F can only be tipped up to about 42 degrees and still return to an upright orientation. Thus, a channelizer 20 provided with footpads 60 according to the invention can be tipped until the angle A between the longitudinal axis L defined by the drum 30 and the surface of the roadway is less than about 30 degrees.

The base 50 is formed of a hardenable liquid resin such that the base is curable to form a solid base that is substantially resilient after curing and is relatively heavy compared to the weight of the lightweight, plastic drum 30. The hardenable liquid resin comprises polyvinylchloride (PVC), a plasticizer and a specific gravity increasing agent. The liquid resin may have any composition that has a composite specific gravity greater than about 1.25 so that the weight of the base is between about 8 and about 40 pounds. Preferably, however, the composite specific gravity of the composition is about 1.76 so that the weight of a cured base having a diameter of about 24 inches is about 25 pounds. The composition of the liquid resin may also include a filler, a coloring agent, a stabilizing agent and a viscosity and lubricating agent.

Preferably, the composition of the liquid resin includes at least one off-grade, recyclable PVC resin, a plasticizer, a specific gravity increasing agent, austin black and/or a filler, calcium oxide and mineral spirits in amounts sufficient to form a resilient base that is resistant to chemical degradation and extreme temperatures. The use of the off-grade PVC resin permits the base to be manufactured economically using a slush molding process to be described in greater detail hereinafter.

The plasticizer provides the resiliency which allows the base to withstand repeated impacts from vehicles without breaking apart and the flexibility which permits the base to conform to the surface of the roadway. The plasticizer may be any known plasticizing agent selected from the group consisting of chlorinated polyethylene resins, ethylene-vinyl acetate resins, phthalate esters, aliphatic esters and phosphate esters. Preferably, however, the plasticizer is dioctyl terephthalate (DOTP).

The amount of plasticizer in the composition of the liquid resin may be varied significantly depending on the amount required to obtain the desired resiliency and flexibility of the base. Typically, the amount of plasticizer will be greater than about 100 parts of plasticizer per 100 parts of liquid resin (PHR), but less than about 200 PHR. Preferably, the amount of plasticizer is greater than about 100 PHR and less than about 150 PHR. The base 50 is thus resilient enough to withstand repeated impacts with a vehicle without permanently deforming, flexible enough to conform to the surface of the roadway, and yet stiff enough to stabilize the drum 30 against wind forces and vacuum forces created by passing vehicles.

The specific gravity increasing agent permits the base to have a weight sufficient to stabilize the channelizer against displacement and tipping without external ballasting. The specific gravity increasing agent may be any substance which results in a composite specific gravity for the composition greater than about 1.25. Examples of suitable specific gravity increasing agents include barytes and calcium carbonate. Preferably, however, the specific gravity increasing agent is barytes foam-A.

The austin black produces a dark color and a consistent appearance. The calcium oxide acts as a desiccant, or drying agent, to chemically remove any excess moisture from the composition. The mineral spirits modify the viscosity of the liquid resin to enhance its processability. The incorporation of the plasticizer enhances not only flexibility, but additionally the plasticizer can migrate to the outer surfaces of the base over an extended time such that the base retains its resiliency and lubricated surface.

A significant advantage of the composition of the hardenable liquid resin is that recycled material may be used as a filler. Because the strength requirements are less important than the weight, resiliency, flexibility and integrity requirements of the base, reground PVC, rubber and rigid plastics such as polyethylene and the like may be used as fillers to reduce the production cost of the base. From the standpoint of environmental impact, the ability to recycle natural rubber is particularly beneficial.

In a preferred embodiment, the composition of the hardenable liquid resin is:

| Component | Lbs./Unit |
|---|---|
| off-grade PVC resins | 5.40 |
| DOTP plasticizer | 6.73 |
| barytes foam-A | 11.80 |
| austin black and/or filler | .54 |
| calcium oxide | .11 |
| mineral spirits | .42 |

When the above composition is used to form a base 50 with a footprint of approximately 24 inches by 24 inches, the base has a specific gravity of about 1.76 and a weight of about 25 pounds.

Figure 7:
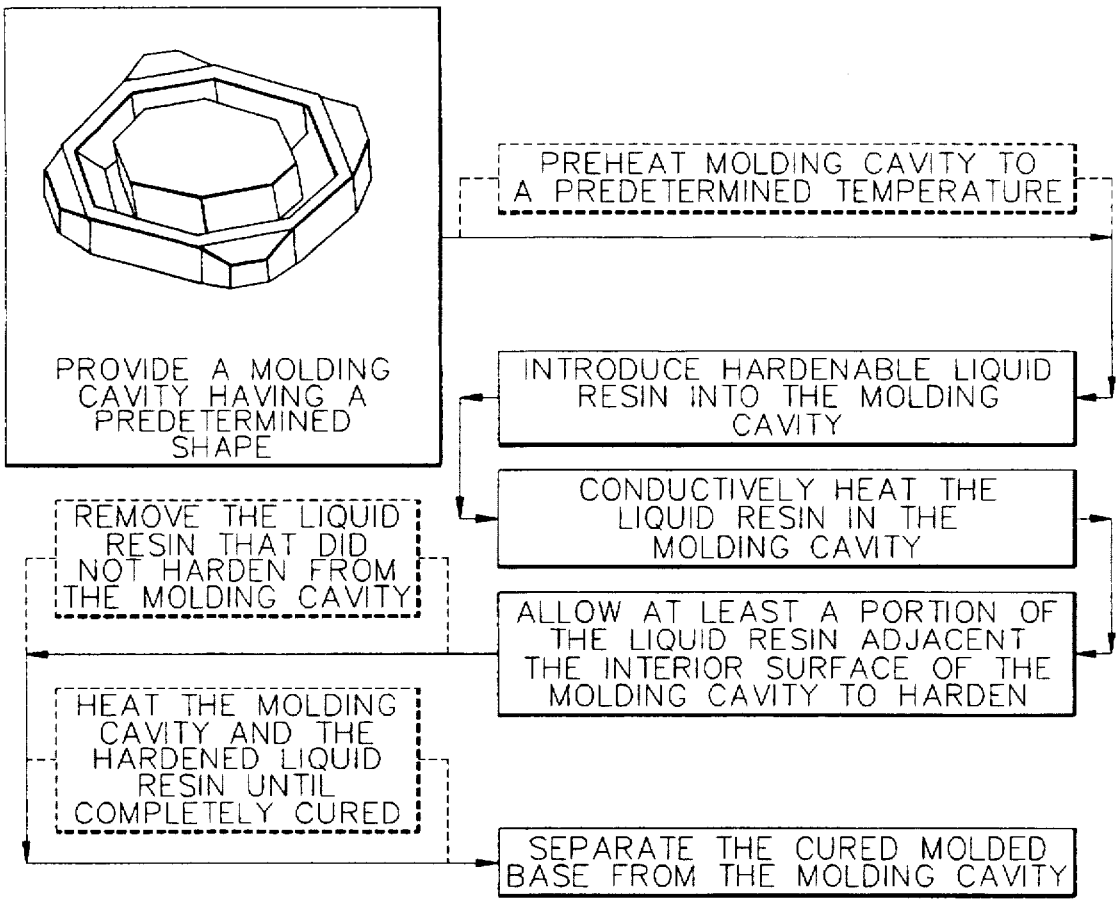
FIG. 7 is a schematic diagram of the slush molding process used to form the base of the traffic channelizer of FIG. 1.

The base 50 is formed by a slush molding process illustrated by the schematic diagram of FIG. 7. The slush molding process produces parts at a high production rate, thus lowering the per piece cost of the base 50. Accordingly, the method of forming the base 50 of the invention permits the base to be manufactured more economically than bases produced using other conventional molding processes typically used for parts having similar thickness.

A metal mold including a molding cavity is provided that conforms to the general shape of the base. The molding cavity has an interior surface defining a predetermined shape corresponding to the top surface 52 of the base 50. Preferably, the mold is preheated to a predetermined temperature sufficient to harden at least a portion of the liquid resin adjacent the interior surface of the mold.

The base is formed by introducing the hardenable liquid resin into the molding cavity in an amount sufficient to cover a predetermined portion of the interior surface of the mold. The liquid resin in the mold is conductively heated until at least a portion of the resin adjacent the interior surface of the mold is hardened. The resin may be conductively heated by, for example, preheating the mold and allowing the liquid resin adjacent the interior surface of the mold to harden under ambient conditions.

The portion of the liquid resin which is not hardened, if any, is then poured out of the mold and collected for recycling to be used to form a subsequent base. The hardened liquid resin in the mold may then be further cured in a conventional oven to obtain a predetermined degree of resiliency. After the hardened liquid resin in the mold is cooled, the base is separated from the mold. Typically, the molded base does not require additional manufacturing operations, such as trimming or flash removal once the finished product is separated from the mold.

As is now apparent, the invention provides a base for a traffic channelizer that does not require external ballasting to stabilize the base against displacement and tipping caused by wind forces and vacuum forces created by passing vehicles and minor impacts from a vehicle. Thus, the need to ballast the channelizer and the problems associated with using sand and sand bags at the worksite are avoided. The invention also provides a method for forming a base for a traffic channelizer that permits the base to be economically manufactured at a high rate of production. The resilient and flexible base formed using the method of the invention is also self lubricating such that it is resistant to chemical degradation and extreme temperatures.

Obviously, many alternative embodiments of the invention are within the ordinary skill of those skilled in the art. Therefore, it is not intended that the invention be limited to the preceding description of illustrative preferred embodiments, but rather that all embodiments with in the spirit and scope of the invention disclosed and claimed herein be included.

That which is claimed is:

1. A method of forming a molded base for a traffic channelizer, the method comprising the steps of:

providing a molding cavity comprising an interior surface, at least a portion of said interior surface defining a predetermined shape;

introducing a hardenable liquid polyvinyl chloride (PVC) resin into said molding cavity in an amount sufficient to cover said portion of said interior surface;

adding a specific gravity increasing agent to the resin to increase the specific gravity of the base to at least about 1.25;

conductively heating at least a portion of said liquid resin adjacent said portion of said interior surface by contact with said portion of said interior surface under conditions sufficient to harden said portion of said liquid resin; and separating said hardened portion of said liquid resin from said molding cavity.

2. The method of claim 1 wherein said hardenable liquid polyvinyl chloride (PVC) resin contains a plasticizer and is curable to form a solid base that is substantially resilient and flexible after curing.

3. The method of claim 1 further comprising the step of removing at least a portion of said liquid polyvinyl chloride (PVC) resin before hardening thereof, said removed portion spaced from said portion of said interior surface by said hardened portion, after the step of conductively heating and before the step of separating.

4. The method of claim 1 further comprising the step of preheating said portion of said interior surface before the step of introducing and wherein the step of conductively heating comprises contacting said liquid polyvinyl chloride (PVC) resin with said preheated mold.

5. The method of claim 1 wherein said liquid resin comprises polyvinylchloride (PVC) and a plasticizer such that the base is self-lubricating and resistant to chemical degradation and extreme temperatures.

6. The method of claim 1 wherein the base has an average diameter less than about three feet and said liquid polyvinyl chloride (PVC) resin contains a specific gravity increasing agent such that the weight of the base is greater than about eight pounds.

7. The method of claim 1 wherein the step of conductively heating comprises subjecting said liquid resin in said molding cavity to a predetermined temperature for a predetermined time to harden at least a portion of said liquid polyvinyl chloride (PVC) resin adjacent said portion of said interior surface.

8. The method of claim 1 further comprising the steps of first removing at least a portion of said liquid polyvinyl chloride (PVC) resin before hardening thereof, said removed portion spaced from said portion of said interior surface by said hardened portion, followed by subjecting the hardened portion of said liquid resin adjacent said portion of said interior surface to a predetermined temperature for a predetermined time after the step of conductively heating and before the step of separating.

9. The method of claim 1 wherein said liquid polyvinyl chloride (PVC) resin contains a filler selected from the group consisting of reground PVC, rubber and rigid plastic.

10. A method of forming a base for a traffic channelizer, the method comprising the steps of:

preheating a molding cavity comprising an interior surface, at least a portion of said interior surface defining a predetermined shape;

introducing a hardenable liquid polyvinyl chloride (PVC) resin into said molding cavity in an amount sufficient to cover said portion of said interior surface;

adding a specific gravity increasing agent to the resin to increase the specific gravity of the base to at least about 1.25;

conductively heating at least a portion of said liquid resin adjacent said portion of said interior surface by contact with said portion of said interior surface of said preheated molding cavity under predetermined conditions of time and temperature sufficient to harden said portion of said interior surface;

removing at least a portion of said liquid resin before hardening thereof, said removed portion spaced from said portion of said interior surface by said hardened portion;

subjecting the hardened portion of said liquid resin adjacent said portion of said interior surface to a predetermined temperature for a predetermined time; and separating the hardened portion of said liquid resin adjacent said portion of said interior surface from said molding cavity.

* * * * *

UNITED STATES PATENT AND TRADEMARK OFFICE
CERTIFICATE OF CORRECTION

PATENT NO. : 5,795,530
DATED : August 18, 1998
INVENTOR(S) : Monda et al.

It is certified that error appears in the above-identified patent and that said Letters Patent is hereby corrected as shown below:

Column 11, line 45, after liquid, insert --polyvinyl chloride (PVC)--.

Column 12, line 3, delete "polyvinyl chloride (PVC)".

Signed and Sealed this
First Day of December, 1998

*Attest:*

*Attesting Officer*

Bruce Lehman

BRUCE LEHMAN

*Commissioner of Patents and Trademarks*